US005896996A

United States Patent [19]

Chuang

[11] Patent Number: 5,896,996

[45] Date of Patent: Apr. 27, 1999

[54] FOLDABLE PACKAGING BOX ASSEMBLY FOR A BEARING

[75] Inventor: William Chuang, Taipei Hsien, Taiwan

[73] Assignee: Hope Industrial Corporation, Taipei Hsien, Taiwan

[21] Appl. No.: 09/086,707

[22] Filed: May 29, 1998

[51] Int. Cl.[6] ..... B65D 85/10; B65D 85/58

[52] U.S. Cl. ..... 206/769; 206/318; 206/445; 206/775; 206/783; 206/806

[58] Field of Search ..... 206/303, 318, 206/445, 756, 764, 769, 775, 776, 783, 806

[56] References Cited

U.S. PATENT DOCUMENTS

| | | | |
|---|---|---|---|
| 2,698,682 | 1/1955 | Bodan | 206/303 |
| 2,757,957 | 8/1956 | Samann | 206/806 X |
| 3,119,541 | 1/1964 | Lynn | 206/806 X |
| 3,302,917 | 2/1967 | Winkler | 206/806 X |
| 3,380,575 | 4/1968 | Hennessey | 206/769 X |
| 3,682,298 | 8/1972 | Guillerm | 206/769 |
| 3,767,043 | 10/1973 | Margolis et al. | 206/806 X |
| 3,929,222 | 12/1975 | Smith et al. | 206/783 |
| 4,887,709 | 12/1989 | Shimamine | 206/775 X |
| 5,284,241 | 2/1994 | Winton et al. | 206/303 |

*Primary Examiner*—Bryon P. Gehman
*Attorney, Agent, or Firm*—Watson Cole Grindle Watson, P.L.L.C.

[57] ABSTRACT

A packaging box assembly includes a box including a bottom plate having a first side and a second side, a first plate having a first end portion foldably extending from the first side of the bottom plate and a second end portion, a first cover foldably extending from the second end portion of the first plate and defining a first elongate slot, a second plate having a first end portion foldably extending from the second side of the bottom plate and a second end portion, and a second cover foldably extending from the second end portion of the second plate and defining a second elongate slot aligning with the first elongate slot. A receiving barrel is detachably received in a space defined between the first plate and the second plate, and a suspension ring is pivotally mounted on a top portion of the receiving barrel and extends through the first elongate slot and the second elongate slot.

6 Claims, 7 Drawing Sheets

FOLDABLE PACKAGING BOX ASSEMBLY FOR A BEARING

FIELD OF THE INVENTION

The present invention relates to a foldable packaging box assembly, and more particularly to a foldable packaging assembly for a bearing.

BACKGROUND OF THE INVENTION

A conventional packaging box for packaging a bearing is shown in FIG. 7, and there will be a complete illustration in the detailed description of the preferred embodiments, concerning the conventional packaging box.

The present invention has arisen to mitigate and/or obviate the disadvantage of the conventional packaging box.

SUMMARY OF THE INVENTION

In accordance with one aspect of the present invention, there is provided a packaging box assembly comprising a box comprising a bottom plate including a first side and a second side, a first plate including a first end portion foldably extending from the first side of the bottom plate and a second end portion, a first cover foldably extending from the second end portion of the first plate and defining a first elongate slot, a second plate including a first end portion foldably extending from the second side of the bottom plate and a second end portion, and a second cover foldably extending from the second end portion of the second plate and defining a second elongate slot aligning with the first elongate slot.

A receiving barrel is detachably received in a space defined between the first plate and the second plate, and a suspension ring is pivotally mounted on a top portion of the receiving barrel and extends through the first elongate slot and the second elongate slot.

In accordance with another aspect of the present invention, there is provided a packaging box assembly comprising an outer box comprising a first inner plate including a first end portion and a second end portion, and a second inner plate including a first end portion foldably extending from the second end portion of the first inner plate and a second end portion connected with the first end portion of the first inner plate.

An inner box is received in the outer box and comprises a bottom plate including a first side and a second side, a first inner plate including a first end portion foldably extending from the first side of the bottom plate and a second end portion, a first cover foldably extending from the second end portion of the first inner plate and defining a first elongate slot, a second inner plate including a first end portion foldably extending from the second side of the bottom plate and a second end portion, and a second cover foldably extending from the second end portion of the second inner plate and defining a second elongate slot aligning with the first elongate slot.

A receiving barrel is detachably received in a space defined between the first inner plate and the second inner plate, and a suspension ring is pivotally mounted on a top portion of the receiving barrel and extends through the first elongate slot and the second elongate slot.

Further features of the present invention will become apparent after a careful reading of the detailed description with appropriate reference to the accompanying drawings.

DETAILED DESCRIPTION OF THE PREFERRED EMBODIMENTS

Figure 7:
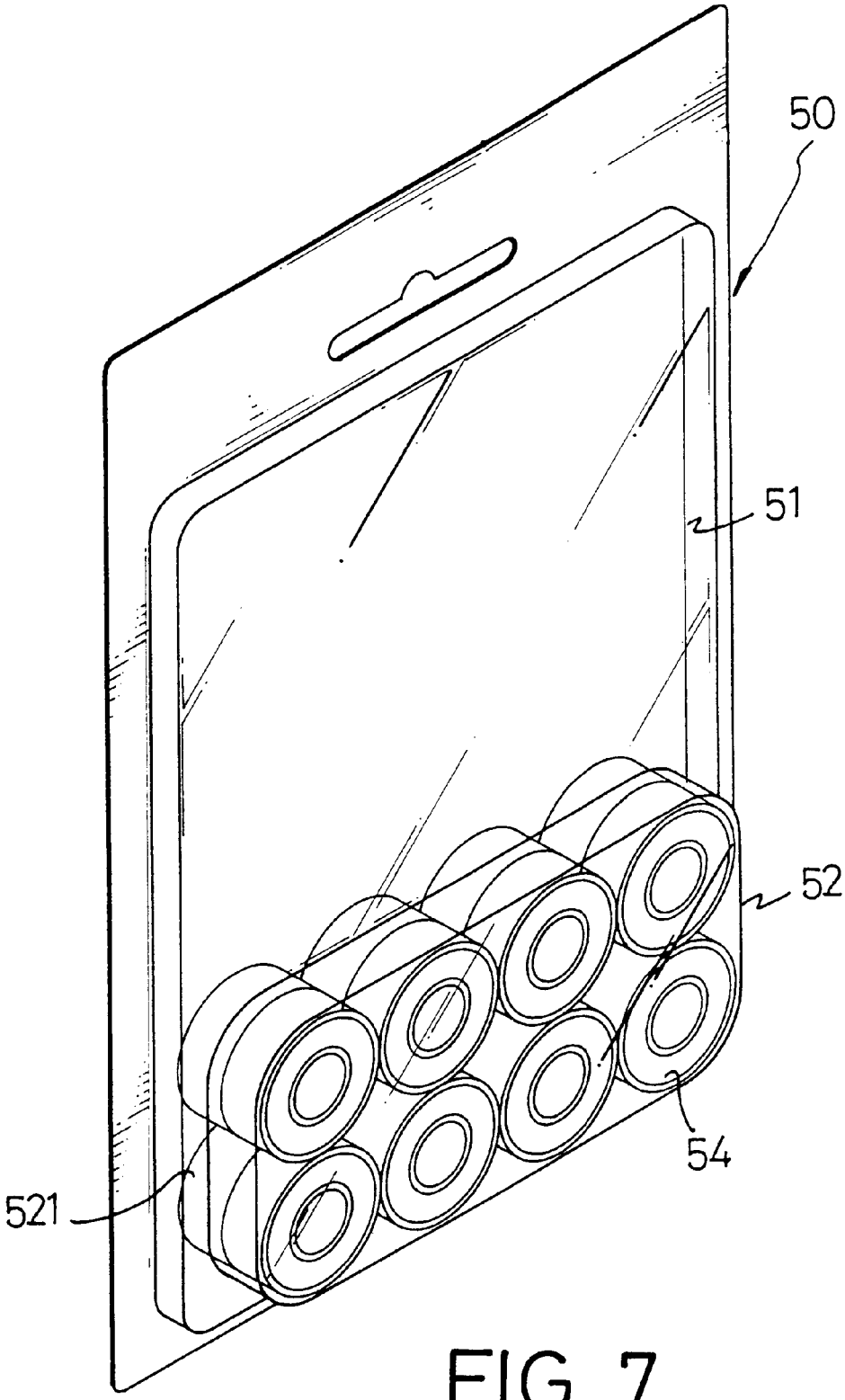
FIG. 7 PRIOR ART
FIG. 7 is a conventional packaging box for a bearing in accordance with the prior art.

For a better understanding of the present invention, reference is made to FIG. 7 illustrating a conventional packaging box 50 in accordance with the prior art.

The conventional packaging box 50 is integrally formed into a closed body 51 which is essentially made of plastic material and is formed with a receiving zone 52 defining a space 521 for receiving a plurality of articles such as bearings 54.

By such an arrangement, however, a user has to destroy the structure of the packaging box 50 for releasing the bearings 54 from the space 521 such that the packaging box 50 has to be discarded after use due to its construction being broken such that the packaging box 30 cannot be reused, thereby limiting the versatility thereof.

Figure 1:
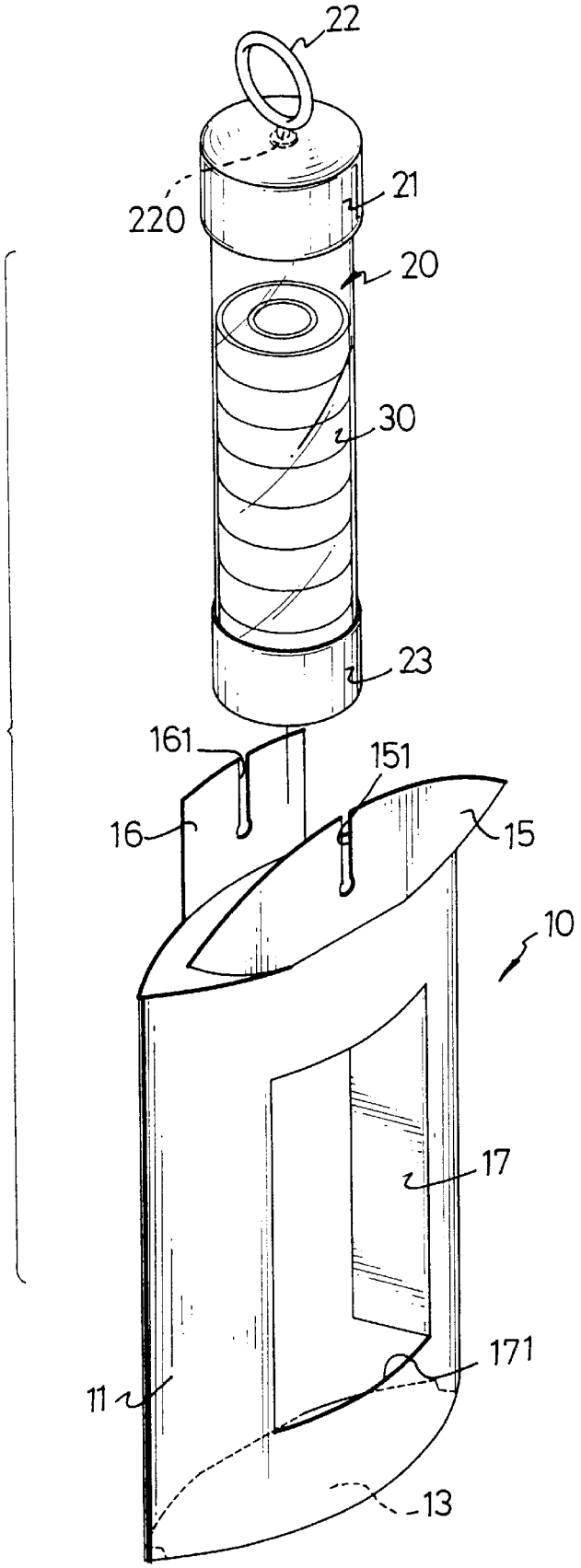
FIG. 1 is an exploded view of a foldable packaging box assembly for a bearing in accordance with a first embodiment of the present invention.
Figure 2:
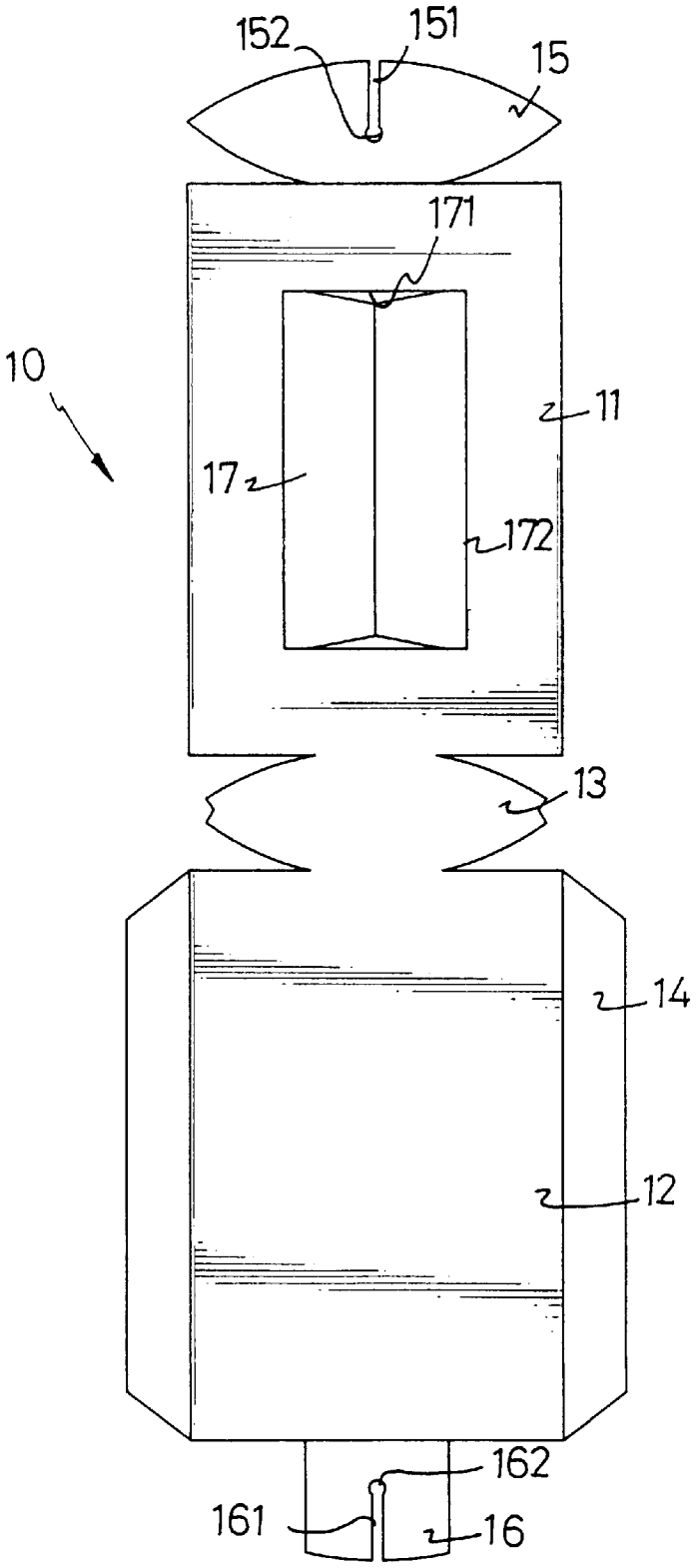
FIG. 2 is a bottom plan view showing a box in an extended or unfolded state.
Figure 3:
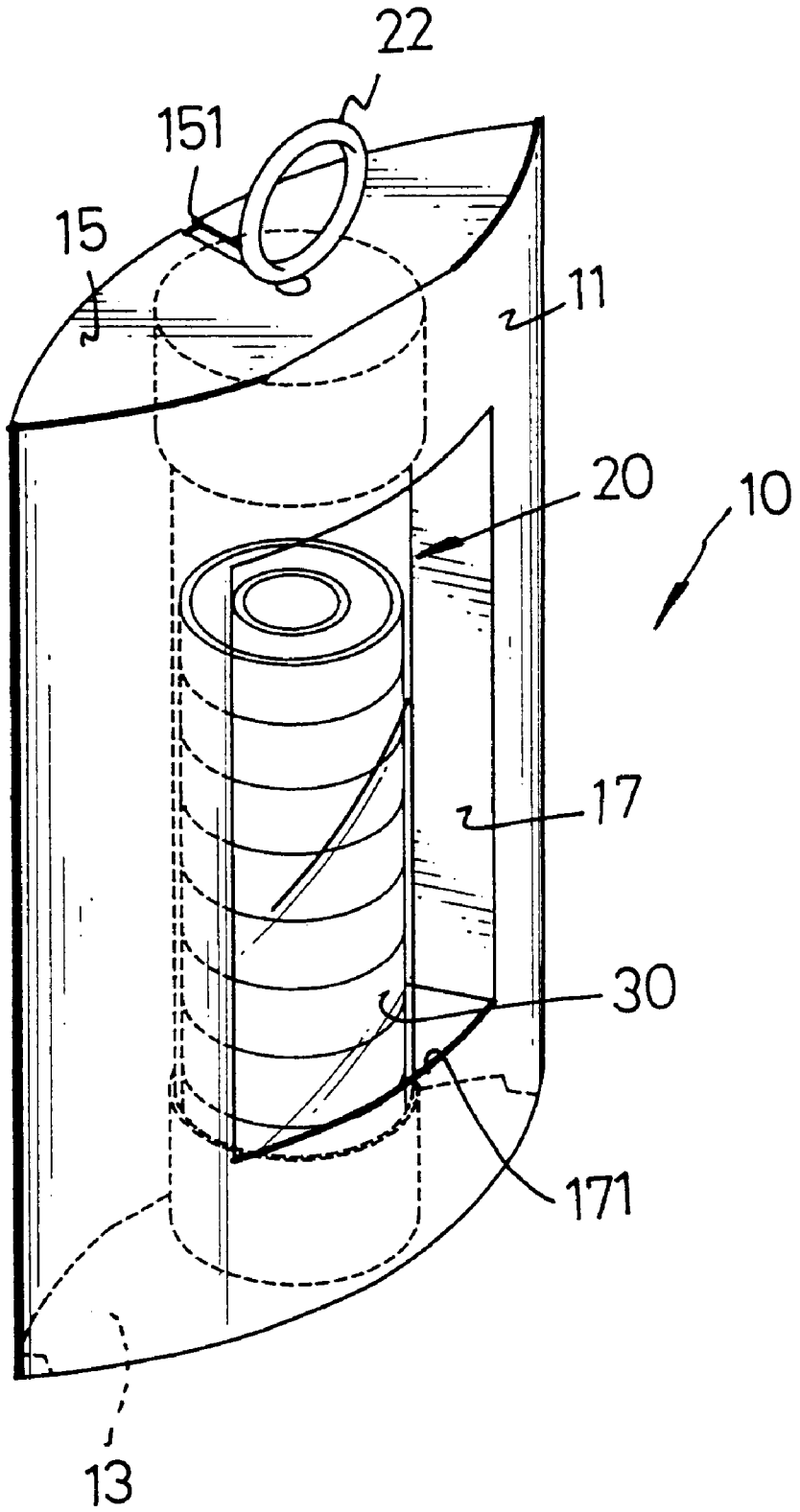
FIG. 3 is a perspective assembly view of the packaging box assembly as shown in FIG. 1.

Referring now to FIGS. 1–3, a packaging box assembly in accordance with a first embodiment of the present invention can be adapted for packaging an article such as a bearing 30 therein.

The packaging box assembly comprises a box 10 comprising a bottom plate 13 including a first side and a second side, a first plate 11 including a first end portion foldably extending from the first side of the bottom plate 13 and a second end portion, a first cover 15 foldably extending from the second end portion of the first plate 11 and defining therein a first elongate slot 151 and a first center hole 152 at the end of the first elongate slot 151, a second plate 12 including a first end portion foldably extending from the second side of the bottom plate 13 and a second end portion, and a second cover 16 foldably extending from the second end portion of the second plate 12 and defining a second elongate slot 161 aligning with the first elongate slot 151 and a second center hole 162 at the end of the second elongate slot 161 and aligns with the first center hole 152 when assembled.

The first plate 11 includes two sides, and the second plate 12 includes two sides each foldably formed with a connecting flap 14 attached to one of the two corresponding sides of the first plate 11 by means such as an adhesive or physical attachment.

A receiving barrel 20 containing the bearing 30 therein is detachably received in a space defined between the first plate 11 and the second plate 12, and includes a top cap 21 and a bottom cap 23. A suspension ring 22 is pivotally mounted on a top portion of the receiving barrel 20 and extends through the first elongate slot 151 and the second elongate slot 161. Preferably, the suspension ring 22 includes a pivot axle 220 pivotally received in the first center hole 152 and the second center hole 162.

The first plate 11 contains a rectangular opening 171 in a mediate portion thereof which includes two sides each foldably formed with a folding line 172 and a swing piece 17 abutting on the receiving barrel 20.

In assembly, referring now to FIG. 1 with reference to FIGS. 2 and 3, the receiving barrel 20 can initially be placed into the space between the first plate 11 and the second plate 12 with the suspension ring 22 being oriented to align with the first slot 151 and the second slot 161. The first cover 15 and the second cover 16 can then be in turn be displaced relative to the suspension ring 22 for passage of the first slot 151 and the second slot 161. The suspension ring 22 can then be rotated relative to the receiving barrel 20 from a first position as shown in FIG. 1 to a second position as shown in FIG. 3, thereby encompassing the receiving barrel 20 in the box 10.

Alternatively, the suspension ring 22 can be rotated to align with the first slot 151 and the second slot 161 such that the first cover 15 and the second cover 16 can be moved from a first position as shown in FIG. 3 to a second position as shown in FIG. 1 such that the receiving barrel 20 can be easily released from the box without a need for destroying or breaking the construction of the box 10.

Figure 4:
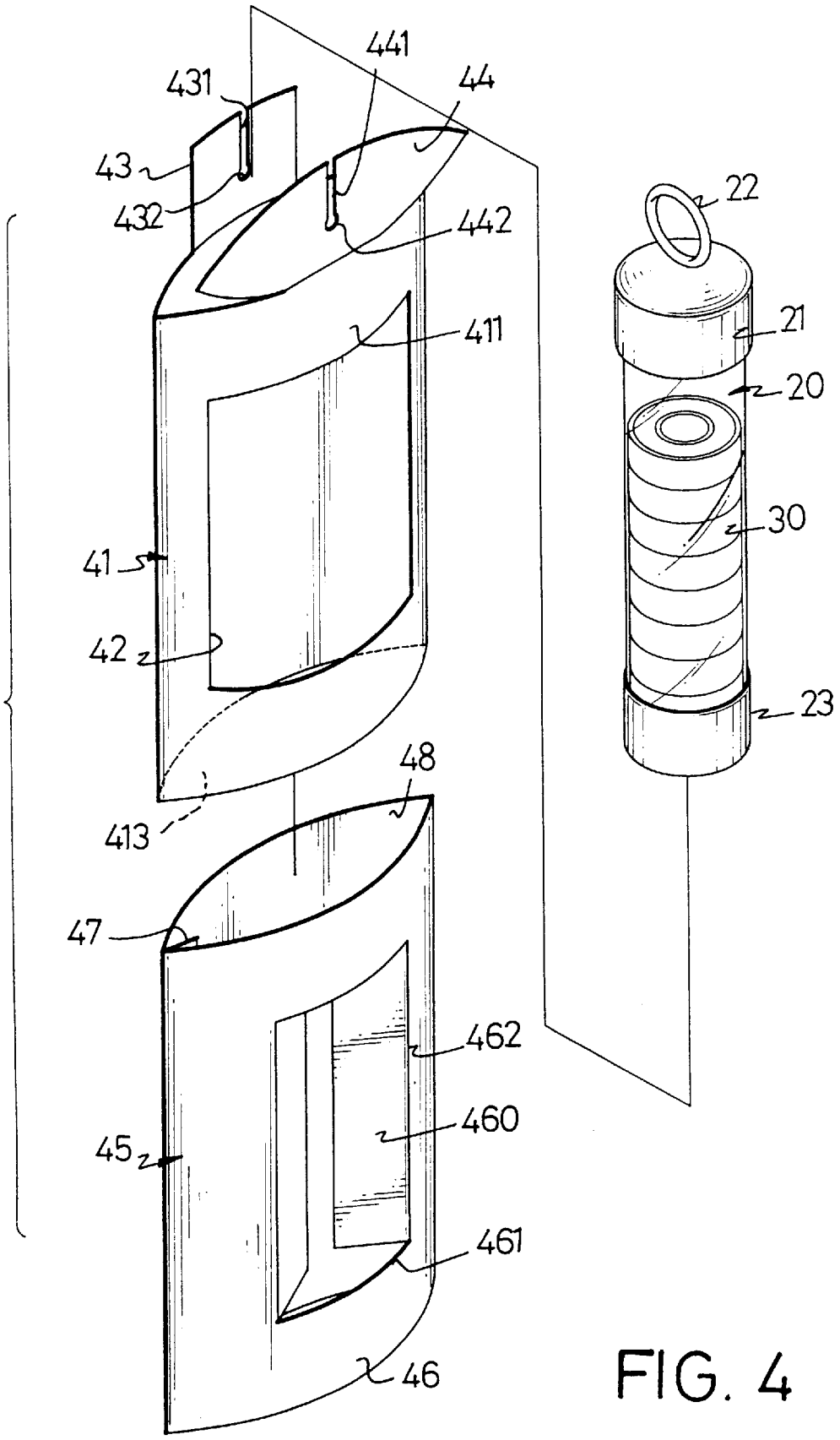
FIG. 4 is an exploded view of a foldable packaging box assembly for a bearing in accordance with a second embodiment of the present invention.
Figure 5:
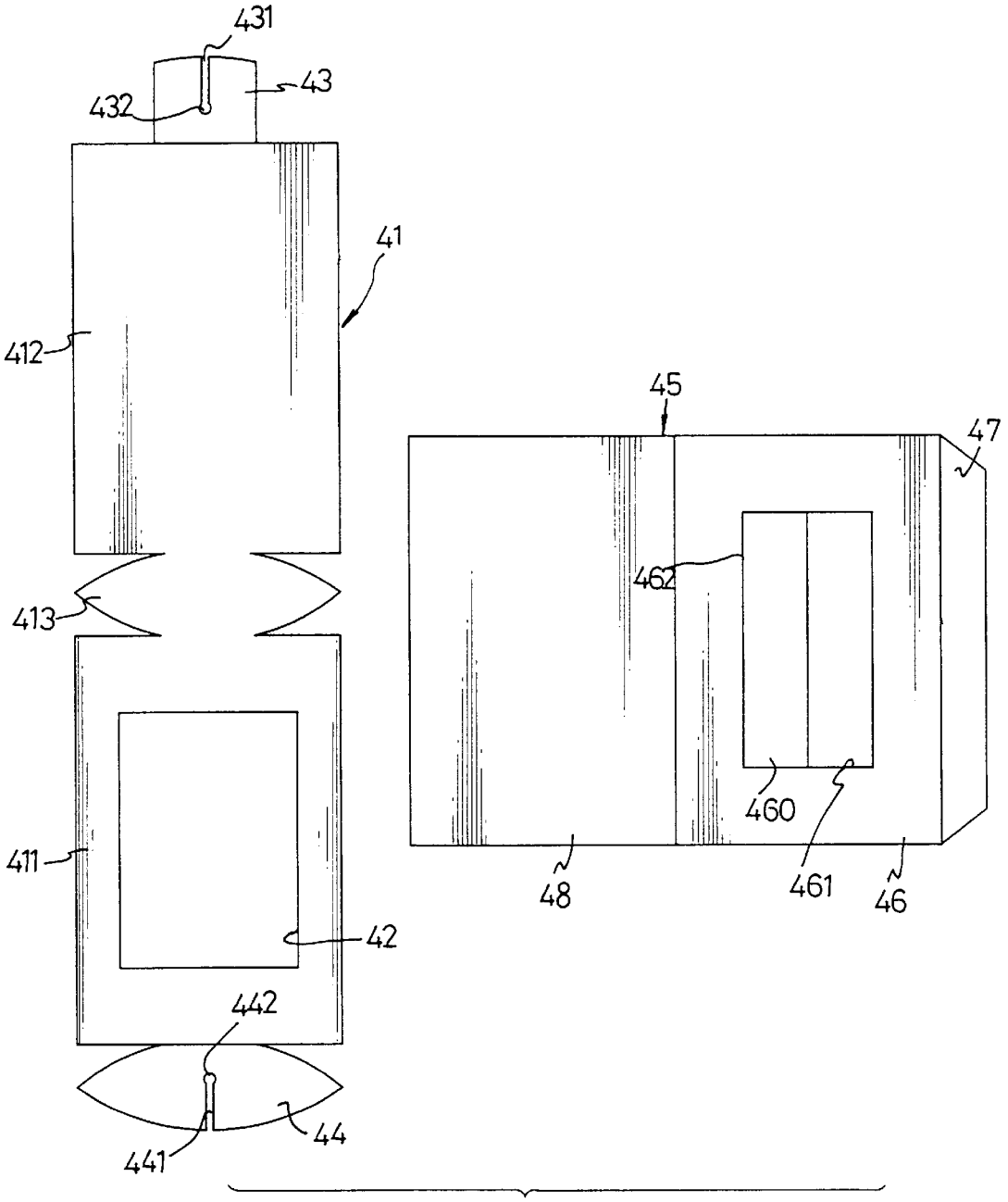
FIG. 5 is a top plan view of the second embodiment showing an inner box and an outer box in an extended or unfolded state.
Figure 6:
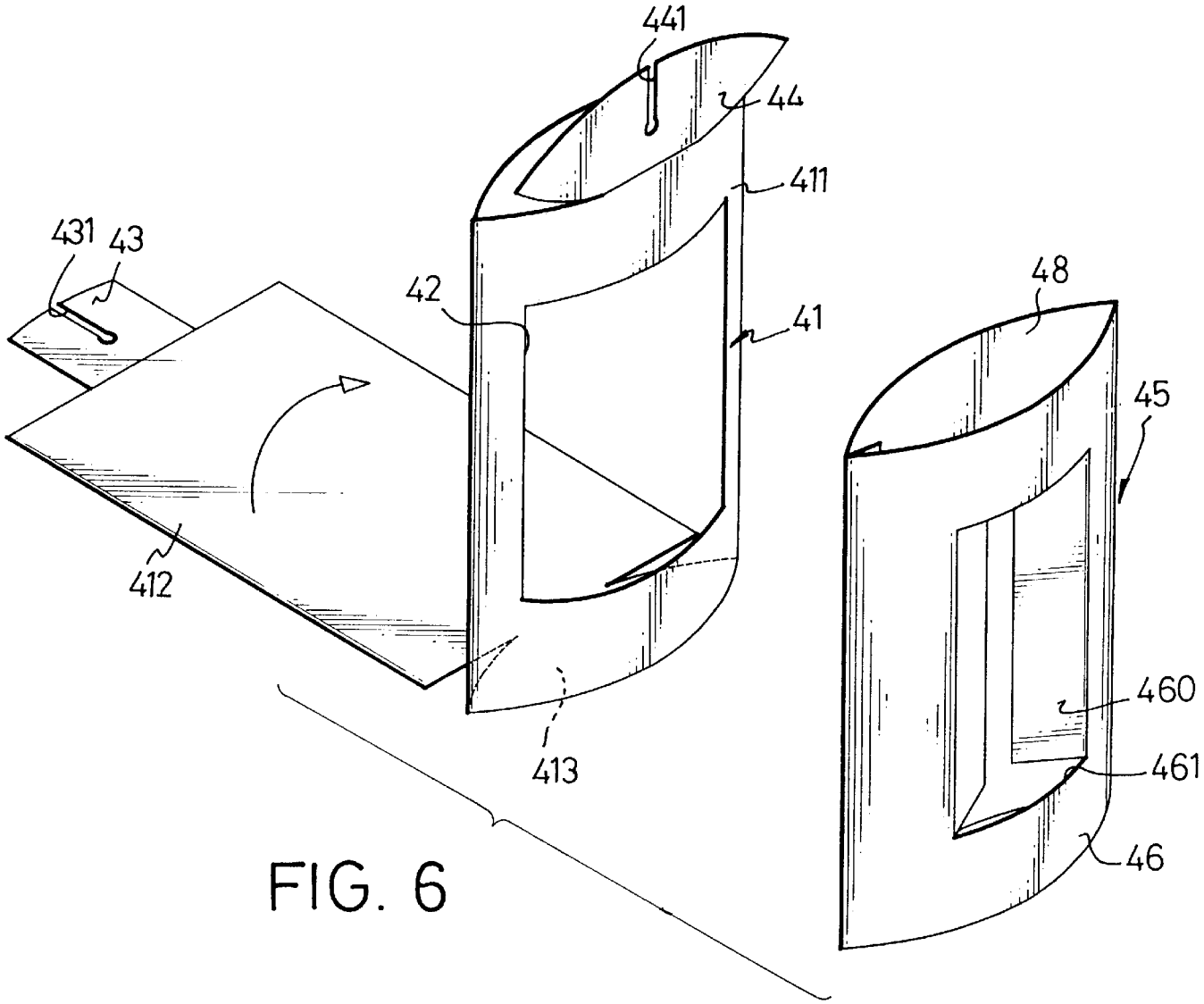
FIG. 6 is an operational view of the inner box and the outer box as shown in FIG. 5.

Referring now to FIGS. 4–6, a packaging box assembly in accordance with a second embodiment of the present invention can be adapted for packaging an article such as a bearing 30 therein.

The packaging box assembly comprises an outer box 45 comprising a first inner plate 46 including a first end portion and a second end portion, and a second inner plate 48 including a first end portion foldably extending from the second end portion of the first inner plate 46 and a second end portion connected with the first end portion of the first inner plate 46. The first end portion of the first outer plate 46 of the outer box 45 is foldably formed with a connecting flap 47 attached to the second end portion of the first outer plate 48 by means such as an adhesive.

An inner box 41 is received in the outer box 45 and comprises a bottom plate 413 including a first side and a second side, a first inner plate 411 including a first end portion foldably extending from the first side of the bottom plate 413 and a second end portion, a first cover 44 foldably extending from the second end portion of the first inner plate 411 and defining a first elongate slot 441 and a first center hole 442, a second inner plate 412 including a first end portion foldably extending from the second side of the bottom plate 413 and a second end portion, and a second cover 43 foldably extending from the second end portion of the second inner plate 412 and defining a second elongate slot 431 aligning with the first elongate slot 441 and defining a second center hole 432 aligning with the first center hole 442 when assembled.

A receiving barrel 20 containing the bearing 30 therein is detachably received in a space defined between the first inner plate 411 and the second inner plate 412, and includes a top cap 21 and a bottom cap 23. A suspension ring 22 is pivotally mounted on the top cover 21 of the receiving barrel 20 and extends through the first elongate slot 441 and the second elongate slot 431.

The first inner plate 411 of the inner box 41 defines a rectangular slot 42 in a mediate portion thereof, and the first outer plate 46 of the outer box 45 defines a rectangular opening 461 in a mediate portion thereof and communicating with the slot 42. The opening 461 includes two sides each formed with a folding line 462 and foldably formed with a swing piece 460 extending into the slot 42 and abutting on the receiving barrel 20.

The operation of the packaging box assembly for encompassing the receiving barrel 20 is similar to that as is disclosed in the first embodiment and will not be further described in detail.

Accordingly, by such an arrangement, the receiving barrel 20 together with the bearing 30 can be easily inserted into or released from the box 10 or the inner box 41 without a need for destroying or breaking the construction of the packaging box assembly such that it can be reused, thereby greatly decreasing the required cost. In addition, the major parts of the packaging box assembly are made of paper which can be easily managed when being discarded without a possibility of creating air pollution.

It should be clear to those skilled in the art that further embodiments may be made without departing from the scope and spirit of the present invention.

What is claimed is:

1. A packaging box assembly comprising:

a box (10) comprising:

a bottom plate (13) including a first side and a second side;

a first plate (11) including a first end portion foldably extending from said first side of said bottom plate (13) and a second end portion;

a first cover (15) foldably extending from said second end portion of said first plate (11) and defining a first elongate slot (151);

a second plate (12) including a first end portion foldably extending from said second side of said bottom plate (13) and a second end portion; and a second cover (16) foldably extending from said second end portion of said second plate (12) and defining a second elongate slot (161) aligning with said first elongate slot (151);

a receiving barrel (20) detachably received in a space defined between said first plate (11) and said second plate (12); and a suspension ring (22) pivotally mounted on a top portion of said receiving barrel (20) and extending through said first elongate slot (151) and said second elongate slot (161).

2. The packaging box assembly in accordance with claim 1, wherein said first plate (11) defines a rectangular opening (171) in a mediate portion thereof, said opening (171) including two sides each foldably formed with a swing piece (17) abutting on said receiving barrel (20).

3. The packaging box assembly in accordance with claim 1, wherein said first plate (11) includes two sides, and said second plate (12) includes two sides each foldably formed with a connecting flap (14) attached to a corresponding one of said two sides of said first plate (11).

4. A packaging box assembly comprising:

an outer box (45) comprising a first inner plate (46) including a first end portion and a second end portion, and a second inner plate (48) including a first end portion foldably extending from said second end portion of said first inner plate (46) and a second end portion connected with said first end portion of said first inner plate (46);

an inner box (41) received in said outer box (45) and comprising:

a bottom plate (413) including a first side and a second side;

a first inner plate (411) including a first end portion foldably extending from said first side of said bottom plate (413) and a second end portion;

a first cover (44) foldably extending from said second end portion of said first inner plate (411) and defining a first elongate slot (441);

a second inner plate (412) including a first end portion foldably extending from said second side of said bottom plate (413) and a second end portion; and a second cover (43) foldably extending from said second end portion of said second inner plate (412) and defining a second elongate slot (431) aligning with said first elongate slot (441);

a receiving barrel (20) detachably received in a space defined between said first inner plate (411) and said second inner plate (412); and a suspension ring (22) pivotally mounted on a top portion of said receiving barrel (20) and extending through said first elongate slot (441) and said second elongate slot (431).

5. The packaging box assembly in accordance with claim 4, wherein said first inner plate (411) of said inner box (41) defines a rectangular slot (42) in a mediate portion thereof, and said first outer plate (46) of said outer box (45) defines a rectangular opening (461) in a mediate portion thereof and communicating with said slot (42), said opening (461) including two sides each foldably formed with a swing piece (460) extending into said slot (42) and abutting on said receiving barrel (20).

6. The packaging box assembly in accordance with claim 4, wherein said first end portion of said first outer plate (46) of said outer box (45) is foldably formed with a connecting flap (47) attached to said second end portion of said first outer plate (48).

* * * * *